United States Patent [19]

Olsen

[11] 4,208,047

[45] Jun. 17, 1980

[54] EXERCISER AND TENSION RELIEVING DEVICE

[76] Inventor: Gerald P. Olsen, P.O. Box 286, Kemmerer, Wyo. 83101

[21] Appl. No.: 946,085

[22] Filed: Sep. 26, 1978

[51] Int. Cl.[2] ..... A63B 5/00

[52] U.S. Cl. ..... 272/67; 272/137; 272/141; 272/DIG. 4

[58] Field of Search ..... 272/137, 141, 143, 116, 272/135, 67, DIG. 4; 403/227

[56] References Cited

U.S. PATENT DOCUMENTS

| | | | |
|---|---|---|---|
| 3,396,967 | 8/1968 | Brown | 272/141 X |
| 3,717,338 | 2/1973 | Hughes | 272/67 |
| 3,830,493 | 8/1974 | Miller | 272/67 |

*Primary Examiner*—William R. Browne
*Attorney, Agent, or Firm*—Frank P. Cyr

[57] ABSTRACT

An exerciser and tension reliever comprising a pair of compressible members disposed between a pair of flanges, the compressible members being provided with aligned central openings extending throughout the length of the compressible members and a pair of externally threaded bolt members extend into the said central openings. Elements are provided for rotating each of the said bolt members with respect to one another and when the threaded members are so rotated with respect to one another, the compressible members are caused to be compressed until the compressive forces applied to the compressible members are such as to overcome the forces retaining the threaded members in engagement with one another and when this occurs the threads of one of the threaded members will be caused to slip over the next adjacent threads of the other threaded member causing a clicking sound and simultaneously therewith the compressible members will return to their original uncompressed condition.

2 Claims, 3 Drawing Figures

FIG. 1
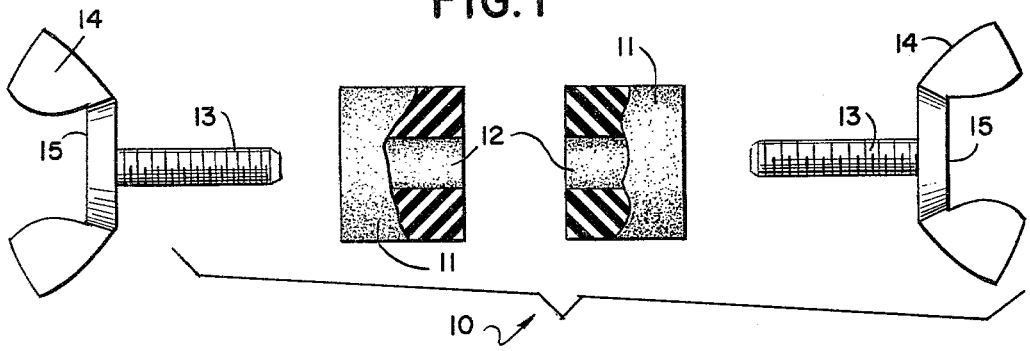
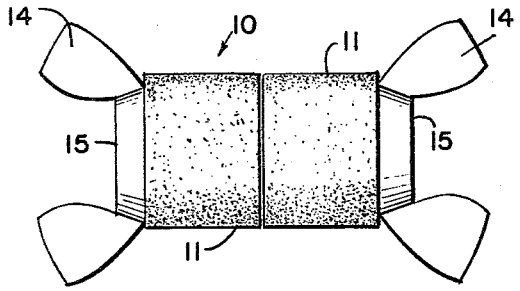
FIG. 2
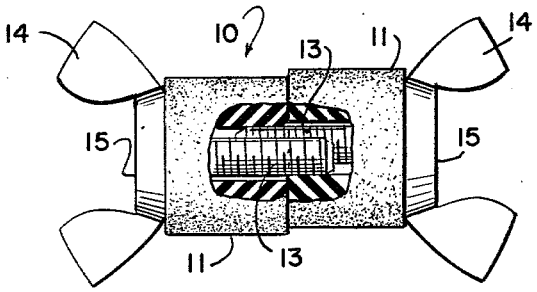
FIG. 3

EXERCISER AND TENSION RELIEVING DEVICE

OBJECTS OF THE INVENTION

One of the objects of the invention is to provide a hand held device which will enable the user thereof to apply a force thereto which will exercise the fingers, wrist and arm muscles of the user thereof.

Another object of the invention is to provide a relatively small and compact device which can be pocket or handbag carried and used by a person to keep his fingers and hands active into doing some manipulation to thereby respond to a mental urge to be doing something with his hands which is usually brought about by a nervous condition.

Other objects and advantages of the invention will be apparent during the course of the following detailed description.

DESCRIPTION OF THE DRAWINGS

FIG. 1 is an exploded view of a front elevation of the subject invention with the parts thereof shown disengaged from one another.

FIG. 2 is a front elevation of the device shown in assembled relationship, and,

FIG. 3 is a front elevation, with parts broken away showing the engagement of the bolt members and showing the manner in which the threads of one threaded member engages with the threads of another threaded member.

DESCRIPTION OF THE PREFERRED EMBODIMENTS

Referring now to the drawings wherein like reference numerals are employed to designate like parts throughout the several views thereof, numeral 10 designates in general the exerciser and tension reliever of the present invention. Essentially, the structure comprises a pair of compressible members 11 which may be constructed of rubber or other compressible material. The compressible members 11 will be referred to as grommets and a bore 12 extends through each of the aforementioned grommets. The grommets 12 may be cylindrical in shape or the same may be square or may be of any other external shape provided only that the same be formed of a compressible material and a bore extends through the said grommets. Two such grommets are shown in the drawings but it is obvious that more than two such grommets may be employed, the only requirement being that the grommets be formed of a compressible material and a bore extends through each of the said grommets. To enhance the outward appearance of the grommets the same may be made from a colored rubber composition or the outside of the grommets may be coated with a suitable coloring composition.

Extending within the apertures or bores 12 are a pair of externally threaded bolt members 13. The diameter of the said bores is such as to permit for each bolt member to be inserted within the bores with the threads of one bolt member engaging with the threads of the other bolt member. Wing nuts 14 are of conventional construction and each has a flange 15 formed as a part of the wing nut. The flange may be circular in formation or may be of other configuration, the only requirement being that the same engage with the end of the grommets. The flange 15 is adapted to contact with the outer ends of the grommets 11 and to bear thereagainst at apply a compressive force against the grommets in a manner to be set forth more fully hereinafter.

To assemble the above described parts to produce the device of the present invention, the bolt members 13 are each inserted into the bores of the grommets so as to cause some of the threaded portion of one bolt member to engage with the threaded portion of the other of said bolt member. Shown in FIG. 2 of the drawings is the arrangement of the parts before a compressive force has been applied against the grommets or compressible members 11. It will be observed that the grommets are in substantial alignment with one another and as shown in FIG. 2 of the drawings, no compressive forces have been applied to the compressible members 11.

Thus far I have described the elements employed in the formation of the exerciser and tension reliever of the present invention.

In use, whether a person wishes to employ the device as a means to exercise the fingers, wrist or arm or if one merely wishes to employ the device as a means to keep his hands busy due to a nervous condition, the wing nuts are grasped one in each hand and the wing nuts rotated relative to one another. The threaded portions of the bolt members 13 will engage with one another and upon continued rotation of the wing nuts, the flanges contacting the grommets will cause a compression of said grommets and such compression will increase upon further turning of the wing nuts. Ultimately, the compressive forces applied to the grommets will be such as to overcome the forces retaining the threaded members into engagement with one another and when this occurs, the threads on one of the said threaded members will be caused to slip over the next adjacent threads of the other threaded member and when this occurs there will be a clicking sound and the grommets will resume their original uncompressed conditions. Upon continued turning of the wing nuts the same operation will be repeated and one may continue turning the wing nuts either as a means for exercising the fingers, hand or wrist of the user thereof or as a means to just keep one's hands busy when such is dictated by reason of a nervous condition.

Various changes may be made in the shape, size and arrangement of parts may be made to the form of the invention herein shown and described without departing from the spirit or the scope of the following claims.

I claim:

1. An exerciser and tension reliever comprising a pair of generally aligned compressible members each having a central bore formed therein, a pair of externally threaded bolt members extending into one of said bores and threadingly meshing engaging with one another, wing nuts secured to each of said externally threaded members, flanges on each of said wing nuts whereby upon rotation of said wing nuts with respect to one another, the said compressible members are compressed and when the compressive forces applied to said compressible members overcomes the force holding said threaded portions of said bolt members, the said bolt members are caused to retract thereby enabling said compressible members to resume to their original uncompressed condition.

2. The structure recited in claim 1 wherein said compressible members are in alignment with one another when said compressible members are in a relaxed condition but are offset to one another when a compressive force is applied thereagainst.

* * * * *